United States Patent [19]

Smith

[11] Patent Number: 4,795,096

[45] Date of Patent: Jan. 3, 1989

[54] DRY MEDIA INJECTION SYSTEM AND DEVICE

[75] Inventor: David H. Smith, Redwood City, Calif.

[73] Assignee: Binks Manufacturing Company, Franklin Park, Ill.

[21] Appl. No.: 57,621

[22] Filed: Jun. 3, 1987

[51] Int. Cl.[4] ..... B05B 1/28; B05B 7/28

[52] U.S. Cl. ..... 239/288.3; 239/314; 239/426

[58] Field of Search ..... 239/310, 314, 418, 426, 239/433, 434, 288–288.5, 522, 523, DIG. 14, 306

[56] References Cited

U.S. PATENT DOCUMENTS

| | | | |
|---|---|---|---|
| 867,806 | 10/1907 | Ditchfield | 239/522 |
| 3,927,833 | 12/1975 | Harrison et al. | 239/306 |
| 4,518,121 | 5/1985 | Smith | 239/306 |

*Primary Examiner*—Andres Kashnikow
*Assistant Examiner*—Karen B. Merritt
*Attorney, Agent, or Firm*—David O'Reilly

[57] ABSTRACT

A system and device for adding dry media to a liquid stream or fan-shaped spray of paint or other suitable liquid material emerging from a spray gun. The dry media are added to the liquid stream by connecting a nozzle spray guard having hose connectors with injectors on opposite sides of the guard. The injection jets are constructed to add dry media at between 45 degrees and 90 degrees to the liquid stream exiting the nozzle of the spray gun. Wing-like appendages on the nozzle guard assist in containing the granular material in the path to impinge on the liquid stream. The liquid stream containing the uniformly mixed dry media or granular material is sprayed on the surface to which it is being applied.

5 Claims, 2 Drawing Sheets

DRY MEDIA INJECTION SYSTEM AND DEVICE

FIELD OF THE INVENTION

This invention relates to a system and device for injecting dry media into a liquid stream and more particularly relates to a system and device for injecting dry media into a paint spray.

BACKGROUND OF THE INVENTION

A variety of methods are used for adding dry media such as sand, reflective beads and other materials to a liquid being sprayed on a surface. Reflective beads are added to provide a reflective surface on roads and pathways. The reflective surface makes the surface more visible to pedestrians and vehicle operators. These reflective areas provide a warning and are used at intersections, or walkways where there might be danger to pedestrians. The beads may be colored red to further alert a person of potential danger.

Dry media are also added to paint to provide a roughened surface to prevent slipping. Sand or other dry material may be added to paint as it is sprayed on steps or walkways to prevent slipping. Also the dry media may be added to paint sprayed on wear treads applied to steps and walkways.

The usual method for adding dry media to a painted surface is to spray or sprinkle dry media on the surface after application of the liquid stream or paint. Adding the dry media to a painted surface after application of the paint is fraught with difficulties. Loss of granular material due to rebounding can be excessive. Further penetration of the dry media into the liquid is effected by the depth of the liquid and the viscosity or liquidity of the paint after it is applied. It is usually imperative that the dry media be added to the painted surface almost immediately after application of the paint, otherwise the paint can dry and the dry media will only stick to the surface. It then can quickly wear off with minimal use requiring reapplication or replacement.

If a surface is flat and the paint is laid on thick enough sprinkling of the dry media can result in some penetration which will prevent loss of the granular material. However this method is not cost effective as a great deal of labor is required to add the dry media to the painted surface. Additional labor costs result from the need to clean up the excess dry media after application.

It is therefore one object of the present invention to provide a system and device for adding dry media to a painted surface simultaneously with application of the paint.

Yet another object of the present invention is to provide a system and method for adding dry media to a liquid stream with minimum waste.

Yet another object of the present invention is to provide a system and method for adding dry media to a liquid stream immediately as the liquid stream exits the spray gun to provide thorough mixing.

Yet another object of the present invention is to provide a system for injecting dry media which impinges on a liquid stream as it exits a spray gun.

Still another object of the present invention is to provide a system and device for adding dry media such as granular material into a single liquid stream with nozzles in opposition to each other impinging on an exiting fluid stream.

Yet another object of the present invention is to provide a system and device for adding dry media to a liquid stream which permits the addition of two different dry media if desired.

Yet another object of the present invention is to provide a system and device for adding dry media to a liquid stream which is comprised of opposing jets intersecting the liquid stream at an angle between 45 and 90 degrees.

BRIEF DESCRIPTION OF THE INVENTION

The purpose of the present invention is to provide a system and device for adding dry media such as granular material, reflective beads or sand to a liquid stream as it exits from a spray gun. The dry media impinges the liquid stream downstream from the spray gun nozzle.

The system and device of the present invention provides a means for adding the dry media to a fan-shaped spray emerging from the spray gun which is connected to spray a fan-shaped fluid ro liquid stream of paint or other suitable material. The dry media are added to the liquid stream by connecting a nozzle spray guard having hose connectors on opposite sides of the guard. The hose connectors mounted on the guard provide injection jets for adding dry media at between 45 degrees and 90 degrees to the fluid stream exiting from the nozzle of the spray gun. The nozzle guard acts as a containment device to assist in containing the granular material in the path to impinge on the liquid stream. The liquid stream containing the granular material is sprayed on the surface to which it is being applied. The dry media are thoroughly mixed with the liquid stream as it is applied to the surface.

Since the dry media are added on opposite sides of a containment nozzle guard two different dry media can be added to the liquid stream if desired. For example, different coarseness granular material can be added to the stream or different color reflective beads. With these possibilities a variety of dry media can be added to a sprayed liquid stream.

The above and other features of the invention will be more fully understood from the following detailed description and the accompanying drawings, in which:

DETAILED DESCRIPTION OF THE INVENTION

Figure 1:
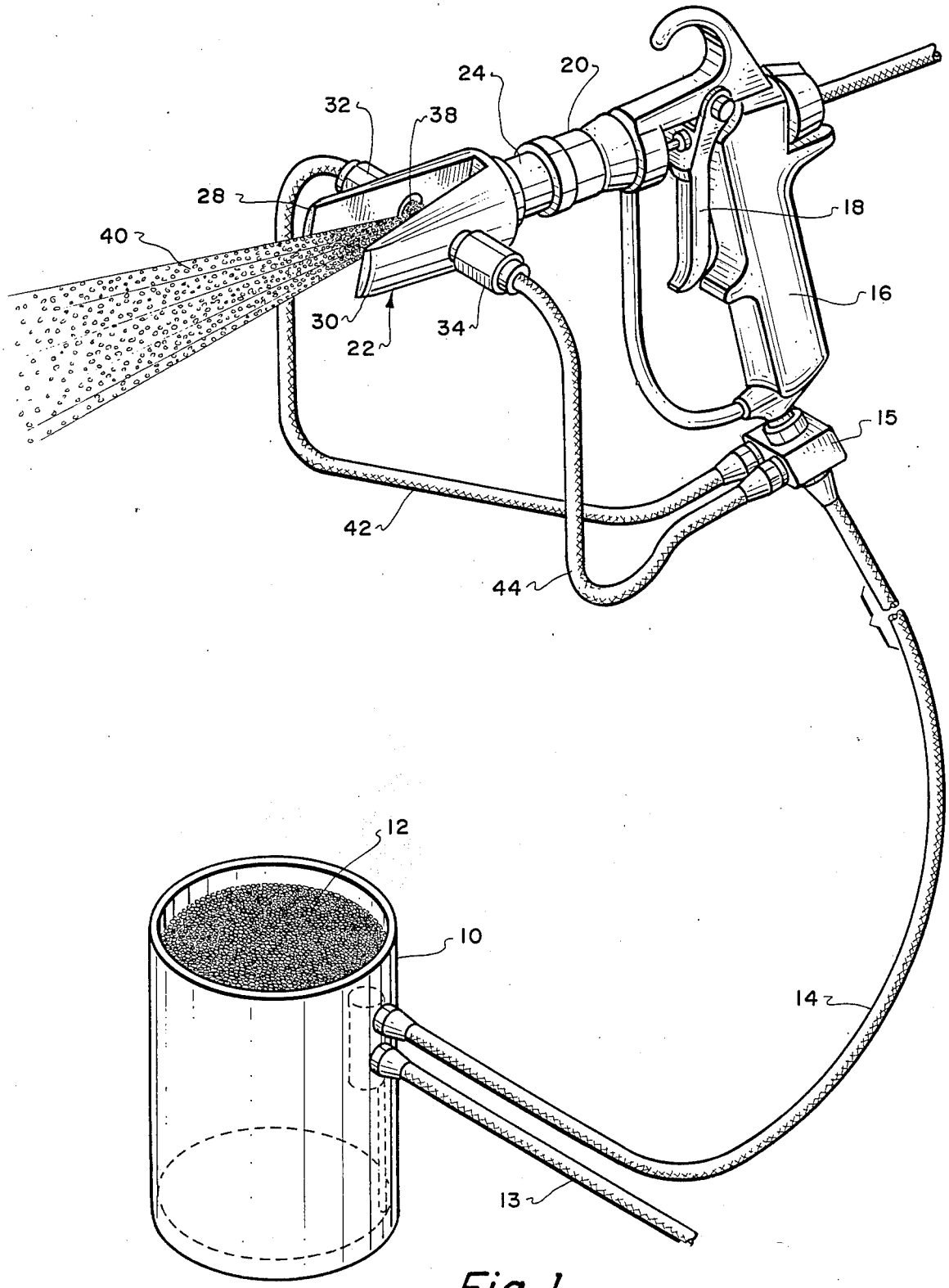
FIG. 1 is a perspective view of a spray gun having the system and device according to the invention.

A system and device for adding dry media to a liquid stream being applied with a spray gun is illustrated in FIG. 1. A dry media tank 10 supplies a dry media 12 to a hose 14 to be delivered to a spray gun 16 which applies a liquid stream to a surface. Operation of trigger 18 releases a spray paint or other fluidic material in a spray pattern from tip 20. The pattern may be fan-shaped or any other pattern desired. Such a spray gun is shown and described in U.S. Pat. No. 4,513,913 issued Apr. 30, 1985 to the same inventor as the device disclosed and described herein and is incorporated herein by reference.

A heavy coat of paint is usually applied to provide street markings at intersections or at pedestrian walkways. To increase the visibility of these street markings, reflective and colored dry media such as beads are added to the paint. Presently these are added by sprinkling or spraying the material on after the paint has been added to the surface. Separate application of the dry media after application of the paint is wasteful and costly. Material can be wasted by overspray or rebound because the liquidity of the paint has diminished due to drying. Also penetration of the dry media into the paint is reduced because it will usually start to dry before application of the dry media.

Figure 2:
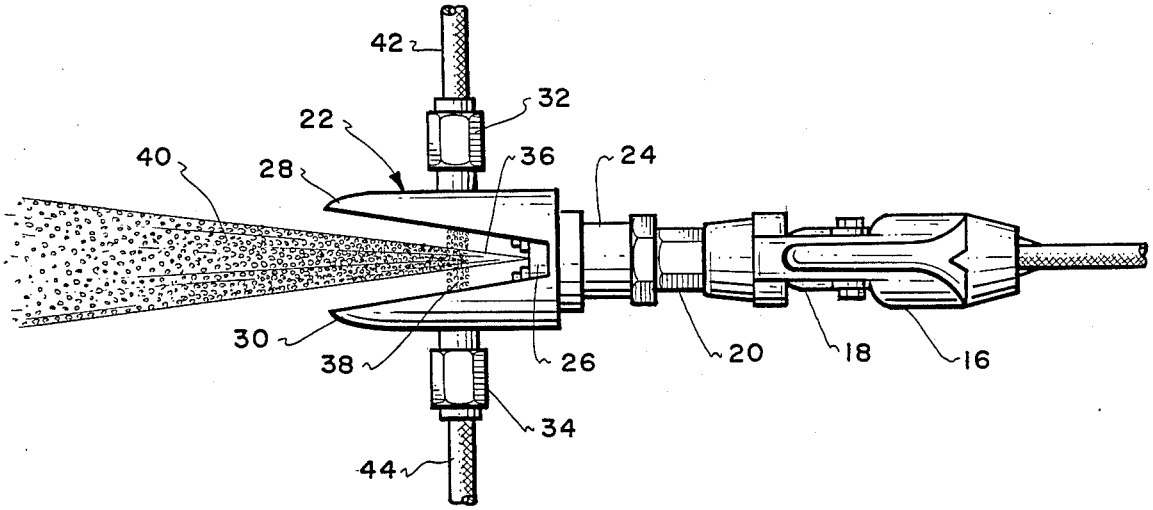
FIG. 2 is a top view of a spray gun having a dry media injection device attached according to the invention.
Figure 3:
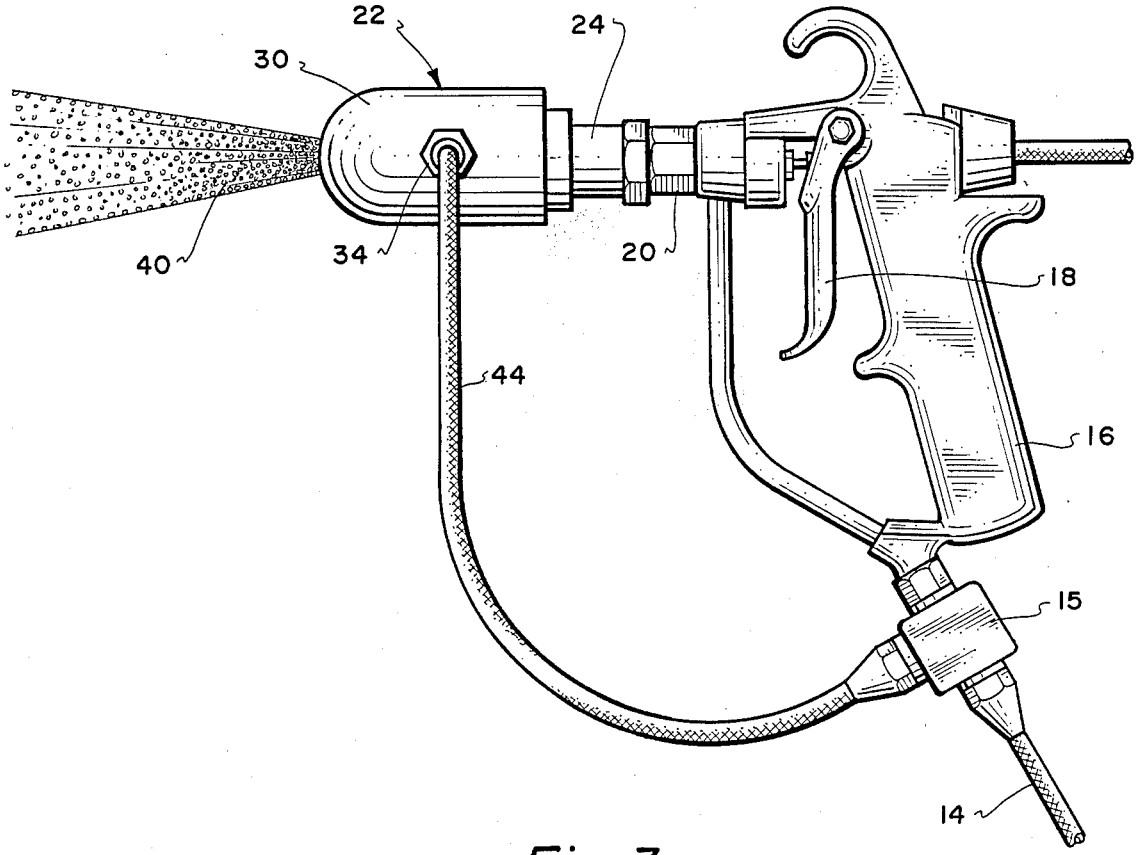
FIG. 3 is a side view of the spray gun having the dry media injection device added to the nozzle according to the invention.

The invention illustrated in FIG. 1 permits the simultaneous application of dry media to the paint as it is sprayed on the surface. Dry media from tank 10 is supplied to injection jets (not shown) in nozzle guard containment device 22, shown in greater detail in FIGS. 2 and 3.

The dry media injection system and device can be adapted for any spray gun 16 having a nozzle 24 for emitting a liquid stream in a fan-shape or other spray pattern. The nozzle guard 22 fits around and is secured by attachment of nozzle tip 26 to the nozzle 24. Nozzle guard has wing-like appendages 28 and 30, extending outward from the nozzle tip 26. Opposing dry media emitting nozzle injection jets are provided by hose connectors 32 and 34 attached to wing-like appendages 28 and 30. Connectors 32 and 34 can be mounted to produce impingement of a liquid fluid stream 36 with dry media 38 at an angle somewhat between 45 and 90 degrees to the direction of the exiting fluid stream.

Fluid stream 36 produces a negative pressure between winglike appendages 28 and 30 which assists in containing dry media 38 in its path to impinge with liquid stream 36. Loss of dry media or granular material 38 is minimized by excess granular material rebounding off the side walls of wing-like appendages 28 and 30 and re-entering liquid stream. The dry media injection device will provide a commingled spray of liquid and granular material 40 uniformly mixed before being deposited on a surface.

Preferably the injecting nozzle jets on connectors 32 and 34 are in direct opposition to each other at 90 degrees to the liquid stream. An impinging path of 90 degrees to the liquid stream will minimize loss of granular material by rebounding from the liquid stream which will provide a commingled spray of liquid and granular material uniformly mixed before being deposited on a surface.

Connectors 32 and 34 are connected by hoses 42 and 44 to tank 10 through manifold 15 and hose 14. Dry media feed is provided by gravity or by air pressure applied from hose 13 to tank 10 to deliver the dry media to hose 14 and manifold 15. As an alternative two different types of granular material 12 could be delivered to the hoses 42 and 44 if desired. For example, two separate dry media feed supplies could be connected separately to each of hoses 42 and 44. This could be different colored reflective beads for addition to the fluid spray or material having different coarseness.

The system disclosed is for use wherever any type of dry media such as reflective beads, sand, or other dry media are to be added to a surface being coated with a liquid material such as paint. To use the system dry media nozzle guard 22 is attached to the spray gun 16 with hoses 42 and 44 connected to a dry media feed system such as tank 10. The dry media feed system is turned on simultaneously with operation of trigger 18 of spray gun 16 causing dry media 38 to impinge on liquid stream 36 exiting nozzle tip 26. Wing-like appendages 28 and 30 partially enclose and contain the dry media impinging the liquid stream causing it to commingle with the liquid and uniformly mix before being deposited on a surface.

Thus there has been disclosed a novel and unique system for adding dry media to paint or other liquids. The system injects dry media into a liquid stream as it is sprayed on a surface. The system includes a dry media containment device in the form of a nozzle guard having dry media injectors for delivering dry media to a liquid stream at angles of between 45 and 90 degrees to the exiting fluid stream.

This invention not to be limited by the embodiments shown in the drawings and described in the description which is given by way of example and not of limitation, but only in accordance with the scope of the appended claims.

What is claimed is:

1. A system for injecting and containing dry media in a liquid stream emitted from a nozzle tip on a spray gun comprising; a nozzle guard secured to said spray gun by attachment of said nozzle tip; said nozzle guard having wringlike appendages extending outward from and substantially surrounding said nozzle tip, opposing dry media injection jets mounted on said nozzle guard winglike appendages on opposite sides of said liquid stream; and dry media supply means supplying dry media to said dry media injection jets; whereby said winglike appendages contain and assist in entraining dry media injected into said liquid stream through said opposing injection jets.

2. The system according to claim 1 in which said dry media supply means comprises; a dry media tank; hose means connecting said dry media tank to said dry media injecting jets; said hose means including a manifold for connecting said two dry media injecting jets to a single dry media tank.

3. The system according to claim 1 in which said dry media supply means includes means for supplying different dry media to each of said dry media injection jets.

4. The system according to claim 3 in which said dry media supply means comprises; means for supplying reflective beads of different color and coarseness to each of said dry media injection jets.

5. The system according to claim 1 in which said dry media injection jets are constricted and arrange to impinge said liquid stream with dry media at an angle between approximately 45 to 90 degrees, whereby said opposing injection jets cause said dry media to impinge on opposite sides of said liquid stream and each other, said winglike appendages acting to direct any rebounding dry media back into said liquid stream.

* * * * *